US007927173B1

(12) United States Patent
Walterscheid

(10) Patent No.: US 7,927,173 B1
(45) Date of Patent: Apr. 19, 2011

(54) TOY VEHICLE LAUNCHED FROM A CONNECTOR CLIP

(76) Inventor: Steve Walterscheid, Bend, OR (US)

( * ) Notice: Subject to any disclaimer, the term of this patent is extended or adjusted under 35 U.S.C. 154(b) by 84 days.

(21) Appl. No.: 12/253,222

(22) Filed: Oct. 16, 2008

Related U.S. Application Data

(60) Provisional application No. 60/999,173, filed on Oct. 16, 2007.

(51) Int. Cl.
*A63H 29/00* (2006.01)

(52) U.S. Cl. ..... 446/429; 446/430; 446/431; 446/435; 446/465; 124/10; 124/16; 124/79

(58) Field of Classification Search ..... 446/429, 446/430, 431, 435, 441, 465; 124/10, 16, 124/79; 24/3.12, 163 K, 170, 634
See application file for complete search history.

(56) References Cited

U.S. PATENT DOCUMENTS 4,423,871 A * 1/1984 Mucaro ..... 463/64
4,715,839 A * 12/1987 Ford et al. ..... 446/28
4,800,629 A 1/1989 Ikeda
5,381,590 A * 1/1995 Liou et al. ..... 24/602
6,148,486 A * 11/2000 Uehara et al. ..... 24/170
6,460,527 B1 * 10/2002 Doepner ..... 124/16
6,520,392 B2 * 2/2003 Thibodeau et al. ..... 224/275
6,615,460 B1 * 9/2003 Baumgarten ..... 24/615
7,533,901 B2 * 5/2009 David et al. ..... 280/801.1

* cited by examiner

*Primary Examiner* — Gene Kim
*Assistant Examiner* — Scott Young
(74) *Attorney, Agent, or Firm* — LaMorte & Associates

(57) ABSTRACT

A toy vehicle and launching system. The male section of a strap connector is attached to the toy vehicle. The male section has elongated arms that extend from the back of the toy vehicle. Separately, the female section of a strap connector is provided. The female section has a connector body with a front opening and side openings. The elongated arms from the male section are insertable into the connector body through the front opening. The elongated arms pass into the connector body until they reach an engaged position. At the engaged position, the elongated arms engage the side openings and retain the elongated arms within the connector body. The elongated arms store spring energy. When released from the engaged position, the energy stored in the elongated arms acts to accelerate the toy vehicle out and away from the connector body.

9 Claims, 5 Drawing Sheets

TOY VEHICLE LAUNCHED FROM A CONNECTOR CLIP

RELATED APPLICATIONS

The application is a continuation-in-part of U.S. Provisional Patent Application No. 60/999,173, filed Oct. 16, 2007, entitled Clip Launched Toy Vehicle.

FIELD OF THE INVENTION

In general, the present invention relates to the structure of toy cars and launchers for toy cars. The present invention also relates to the structure of strap connectors.

BACKGROUND OF THE INVENTION

Many consumer products, such as backpacks, book bags, strollers, and child safety seats contain strapping. Commonly, some of the strapping is terminated with a connector that enables sections of the strapping to be selectively connected or separated.

One of the most common strapping connector is a snap-together connector of the type having a male side and a female side. The male side of the connector contains two elongated arms that deform slightly when they enter the female side of the connector. The arms expand into openings within the female side, therein locking the male and female sides of the connector together. One early example of such a prior art connector is found in U.S. Pat. No. 4,800,629 to Ikeda, entitled Plastic Buckle.

Although many variations of such connector types exist in the marketplace, such connectors are used mainly for selectively interconnection strapping or similar flexible tethers.

Also, in the prior art, there exist many toy cars, motorcycles, airplanes and other such toy vehicles that are designed to be launched. Such toy devices typically require a lunching device for accelerating the toy vehicle into motion. In the prior art, launching devices typically use compressed springs or pulled elastic bands to provide the energy needed to accelerate and launch the toy vehicle. As is often the case, the launching device for a toy vehicle is far more complex and expensive than is the toy vehicle itself. Consequently, the launcher for a toy vehicle, if sold with a toy vehicle, is responsible for most of the cost of the packaged toy.

The present invention provides a toy vehicle that can be launched from the female end of a prior art strapping connector. In this manner, the launching device for the toy vehicle is commonplace and can be provided at little cost. Additionally, the configuration of the present invention enables the toy vehicle to be connected to the strapping of a backpack or similar device. In this manner, the toy vehicle can be connected and carried on any secondary object that contains such a strapping connector.

The structure of the present invention and its associated method of use are described and claimed below.

SUMMARY OF THE INVENTION

The present invention is a toy vehicle and launching system. The toy vehicle can be a car, truck, motorcycle or flying novelty. The male section of a strap connector is attached to the toy vehicle. The male section has at least two elongated arms that extending rearward from the back of the toy vehicle. Separately, the female section of a strap connector is provided. The female section has a connector body with a front opening and side openings. The elongated arms from the male section are insertable into the connector body through the front opening. The elongated arms pass into the connector body until they reach an engaged position. At the engaged position, the elongated arms engage the side openings and retain the elongated arms within the connector body.

The elongated arms store spring energy. When released from the engaged position, the energy stored in the elongated arms acts to accelerate the elongated arms and the toy vehicle out and away from the connector body. This launches the toy vehicle at a velocity fast enough to propel the toy vehicle at least a few feet away from the connector body.

Since the male section and the female section of the launching mechanism are configured as strap connectors, both elements can interconnect with other strap connectors. This enables the present invention to be connected to any strap terminated with a comparable connector.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be used to launch many types of toys vehicles, such as toy airplanes, toy motorcycles, and toy rockets, the present invention is especially well suited for launching a toy vehicle in the form of a car or truck. Accordingly, the exemplary embodiment of the invention selected for illustration is that of a toy car. This embodiment is presented as representing the best mode contemplated for the invention. However, the selected embodiment is a mere example and should not be considered a limitation when interpreting the claims.

Figure 1:
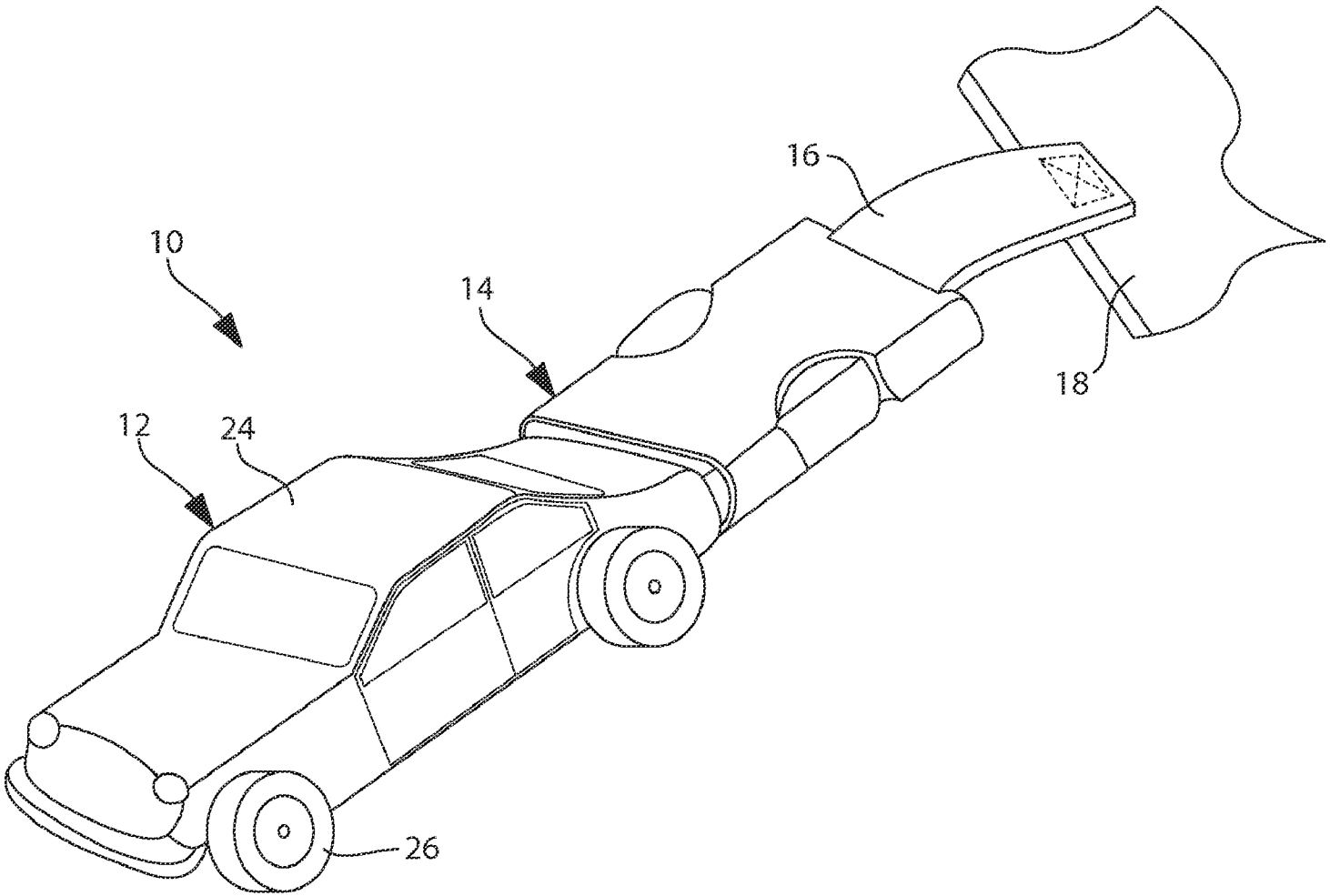
FIG. 1 is a perspective view of an exemplary embodiment of a toy vehicle launching system.

Referring to FIG. 1, an exemplary embodiment of a toy launching system 10 is shown. The toy launching system 10 consists of a toy vehicle 12 and a launching mechanism 14. As will be explained, the launching mechanism 14 is generally configured as a strap connector. Accordingly, part of the launching mechanism 14 can be attached to a strap 16. The strap 16 can be attached to any secondary object 18, such as a backpack, lunch box or the like.

Figure 2:
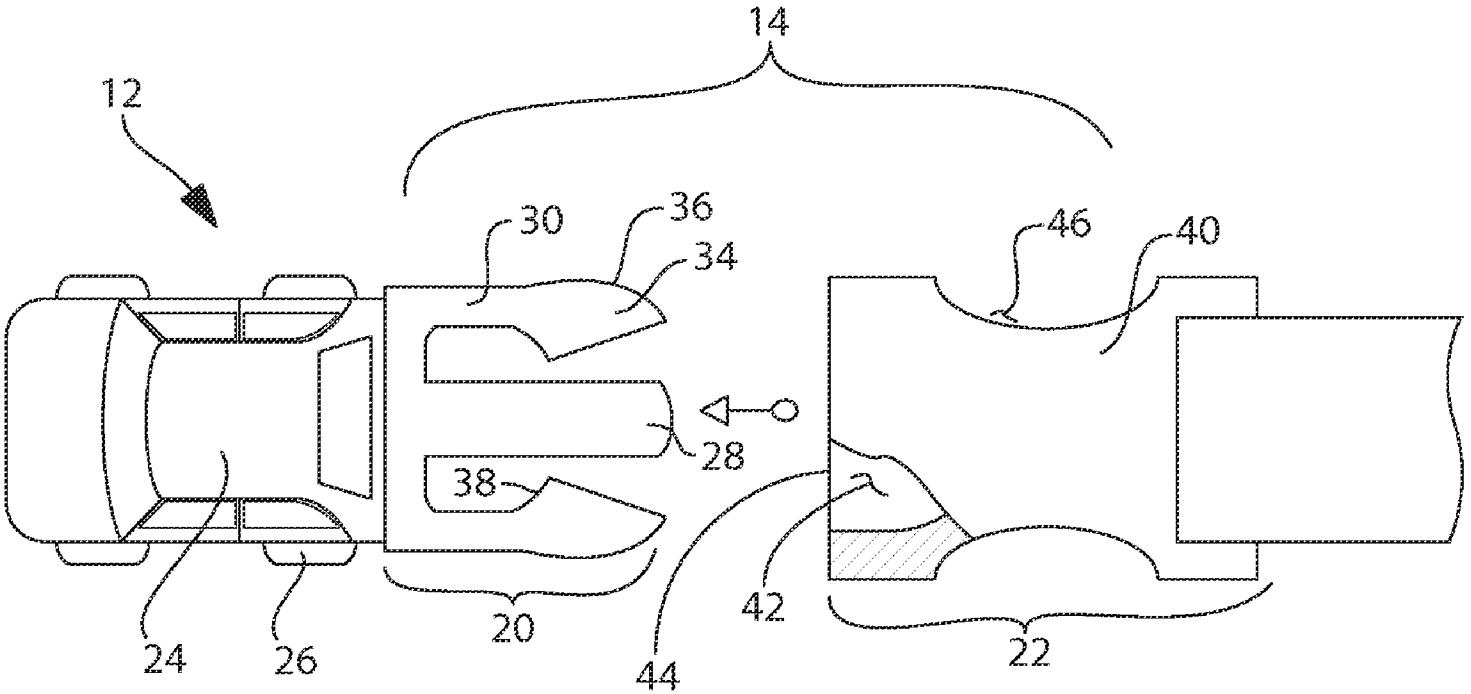
FIG. 2 is a top view of the embodiment of FIG. 1 shown in a disconnected configuration.

Referring to FIG. 2 in conjunction with FIG. 1, it can be seen that the toy vehicle 12 is configured as an automobile. Accordingly, the toy vehicle 12 has both a body 24 that is configured to look like the chassis of an automobile and four wheels 26 that support that vehicle body 24.

The launching mechanism 14 is generally configured as a strap connector. Accordingly, the launching mechanism 14 has a male connector section 20 and a female connector section 22 that selectively interconnect and separate. The male connector section 20 of the launching mechanism 14 is affixed to the rear of the vehicle body 24. The male connector section 20 is weighted so that it extends as a cantilever from the rear of the vehicle body 24 without causing the vehicle body 24 to tip up and rise off its front two wheels.

Figure 3:
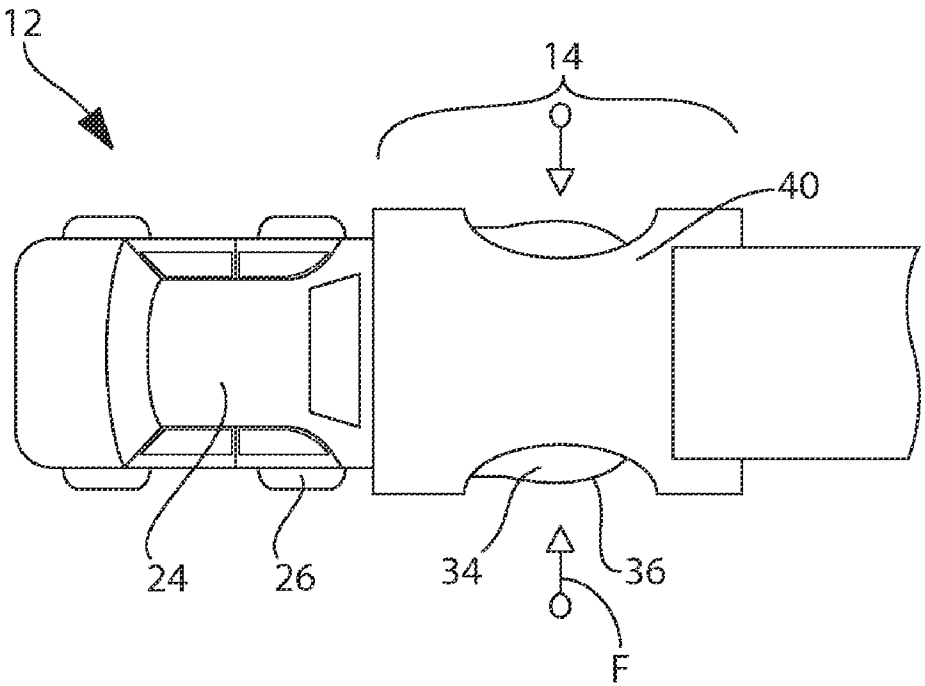
FIG. 3 is a top view of the embodiment of FIG. 1 shown in a connected configuration.

Referring to FIG. 2 in conjunction with FIG. 3, it can be seen that the male connector section 20 of the launching mechanism 14 that extends from the vehicle body 24 includes a center post 28 and two flexible arms 30. The flexible arms 30 are elongated and terminate with shaped head sections 34. The shaped head sections 34 include curved exterior surfaces 36 and an interior locking ledge 38. The curved exterior surfaces 36 are on the outside of the flexible arms 30 and face away from each other. The locking ledges 38 are on the inside of the flexible arms 30 and face toward each other.

The female connector section 22 of the launching mechanism 14 is sized and shaped to receive and interconnect with the male connector section 20 of the launching mechanism 14. The female connector section 22 of the launching mechanism 14 has a body 40 that defines an internal chamber 42. The internal chamber 42 can be accessed through a front opening 44 on the front of the body 40 and by two opposite side openings 46 on the sides of the body 40.

When the male connector section 20 of the launching mechanism 14 is inserted into the front opening 44 on the female connector section 22, the flexible arms 30 pass into the internal chamber 42 and are pushed toward one another. This causes the flexible arms 30 to deform slightly and store spring energy. The male connector section 20 of the launching mechanism 14 is advanced into the female connector section 22 until the locking ledges 38 on the flexible arms 30 engage the side openings 46 in the body 40. Once the flexible arms 30 engage the side openings 46, the male connector section 20 and the female connector section 22 are in an engaged position where a mechanical interconnection prevents the male section 20 from being pulled out of the female connector section 22. Furthermore, the interconnection stores spring energy in the flexible arms 30.

To launch the toy vehicle 12 from the launching mechanism 14, the flexible arms 30 are pressed inwardly with a force F sufficient to overcome the spring bias of the flexible arms 30. The application of the force F is shown in FIG. 3. This causes the flexible arms 30 to disengage from the side openings 46. The inward pressing also further deforms the flexible arms 30 and causes them to store additional spring energy.

Once the flexible arms 30 have disengaged the side openings 46 in the female connector section 22, the spring energy stored in the flexible arms 30 biases the curved exterior surfaces 36 of the flexible arms 30 outwardly. Due to the curvature of the curved exterior surfaces 36 and the shape of the interior of the body 40, the stored spring energy acts to accelerate the male connector section 20 of the launching mechanism 14 away from the female connector section 22. This causes the male connector section 20 of the launching mechanism 14 to separate from the female connector section 22 and move away from the female connector section 22 at a significant velocity. Accordingly, the toy vehicle 12 is propelled forward and rolls upon its wheels 26 for at least a few feet.

Figure 4:
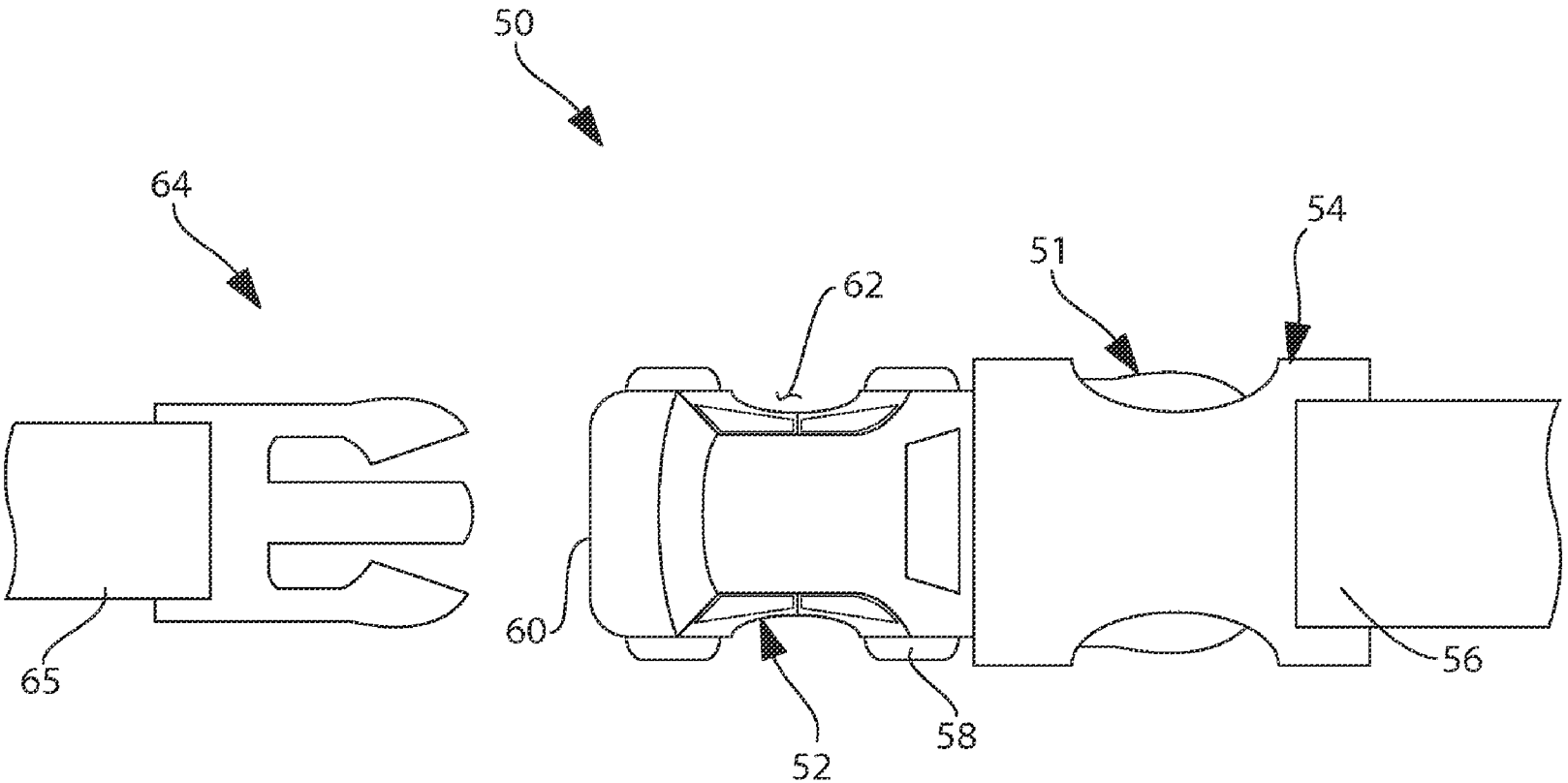
FIG. 4 is a top view of an alternate embodiment of the present invention shown in a disconnected configuration.
Figure 5:
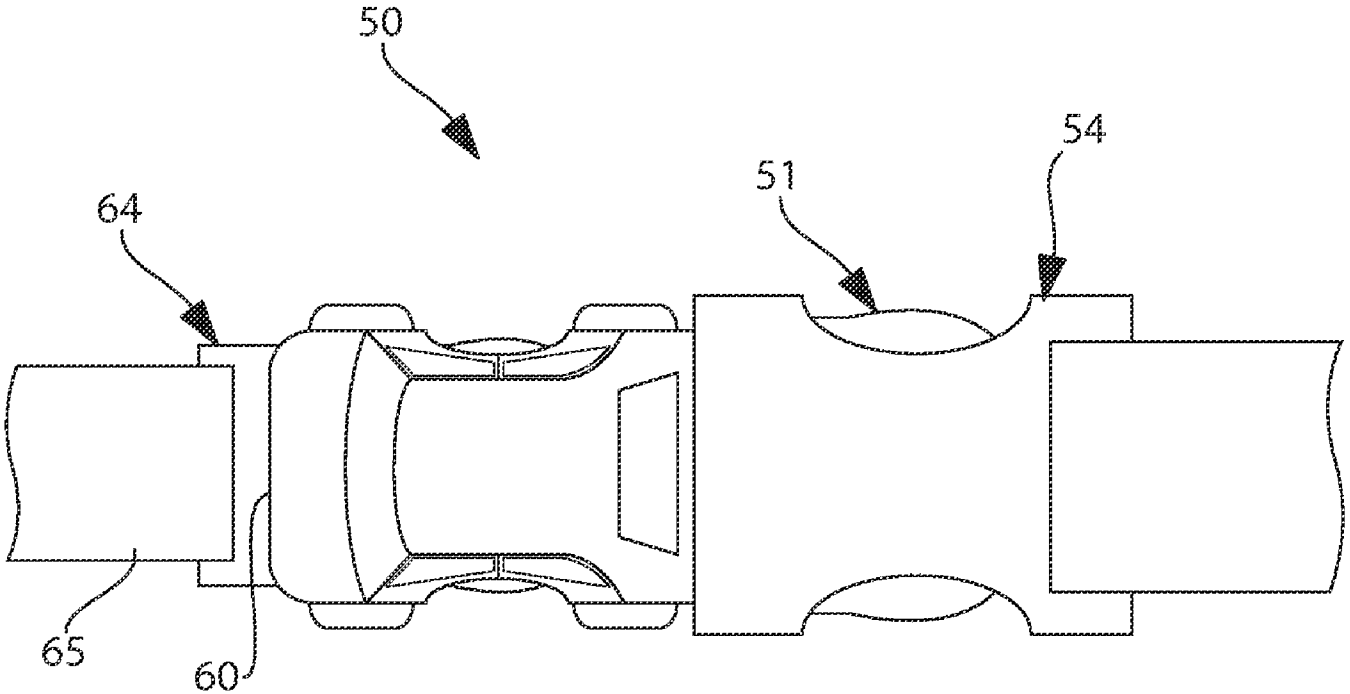
FIG. 5 is a top view of the embodiment of FIG. 4 shown in a connected configuration.

Referring to FIG. 4 and FIG. 5, an alternate embodiment of a toy vehicle launch system 50 is shown. In this embodiment, a toy vehicle 52 is provided. The toy vehicle 52 has a male connector section 51 attached to its back end, in the same manner as has been previously described. The male connector section 51 engages a female connector section 54 of the type previously described. The female connector section 54 is attached to a segment of strapping 56 or a similar flexible tether, such as elastic cording.

The difference between the embodiment of FIGS. 4 and 5 and the earlier embodiment is that the interior of the toy vehicle 52 is configured in the same manner as is the female connector section 54. The toy vehicle 52 has four wheels 58 that enable the toy vehicle 52 to roll. However, the toy vehicle 52 is hollow having a front opening 60 and two side opening 62.

An auxiliary male connector 64 is provided. The male connector 64 can be coupled to additional strapping 65 or to a secondary object. The auxiliary male connector 64 has the same physical configuration as does the male connector section 51 of the launching mechanism. It will therefore be understood that the auxiliary male connector 51 can directly engage the female connector section 54 of the launching mechanism, therein creating a direct connection between the two segments of strapping 56, 65. More importantly, the auxiliary male connector 64 can be inserted into the front opening 60 of the toy vehicle 52, thereby joining the toy vehicle 52 to the auxiliary male connector 64. The male connector section 51 of the toy vehicle launching system 50 can then engage the female connector section 54. The toy vehicle 52 therein becomes interposed between the two segments of strapping 56, 65 and is part of the structure that connects the two segments of strapping 56, 65. This enables the toy vehicle launching system 50 to be incorporated into any secondary object that uses a strap connector to attach separate segments of strapping.

It will be understood that the embodiments of the present invention that are shown are merely exemplary and variations can easily be made by those skilled in the art. For instance, the shape of the toy vehicle can be changed as a matter of design choice. Furthermore, the shape of the connector elements in the launching mechanism can be altered in appearance. All such variations, modifications and alternate embodiments are intended to be included within the scope of the present invention as defined by the claims.

What is claimed is:

1. A system for launching a toy vehicle, said system comprising:

a toy vehicle having a vehicle body supported on wheels, wherein said vehicle body has a first end and a second end;

at least two elongated arms extending rearward from said second end of said vehicle body;

a female connector body having a front opening and side openings, wherein said elongated arms are insertable into said front opening of said female connector body to an engaged position, wherein said elongated arms mechanically interlock with said female connector body, and said elongated arms within said female connector are exposed through said side openings of said connector body, and wherein said elongated arms store spring energy that accelerates said elongated arms and said toy vehicle out and away from said female connector body when a force is applied to said elongated arms through said side openings that displaces said elongated arms from said engaged position.

2. The system according to claim 1, wherein said elongated arms extend as cantilevers from said second end of said vehicle body when supported by said wheels.

3. The system according to claim 1, further including a flexible tether coupled to said connector body.

4. The system according to claim 1, further including a male connector body, separate from said toy vehicle, that is configured to pass into and mechanically engage said female connector body.

5. The system according to claim 4, wherein said vehicle body is configured to receive said male body connector through said first end and mechanically engage said male connector.

6. A launching system for a toy vehicle, comprising:

a female connector body that defines an interior accessible through a front opening and two side openings;

a toy vehicle body having a front end and a rear end, wherein said toy vehicle body defines an interior accessible through a front end opening;

two elongated arms extending as cantilevers from said rear end of said toy vehicle body, wherein said elongated arms are insertable through said front opening of said female connector body to a locked position where said elongated arms engage said two side openings, wherein said elongated arms deform and create a bias force that acts to move said toy vehicle body away from said female connector body when not in said locked position;

a male connector body, separate from said toy vehicle and said female connector body, that selectively connects to either said toy vehicle body through said front end opening or said female connector body through said first opening.

7. The launching system according to claim 6, wherein said toy vehicle body rolls on wheels.

8. The system according to claim 6, wherein said elongated arms each have curved exterior surfaces that face away from one another.

9. The system according to claim 6, wherein said elongated arms each have locking ledges that face toward one another.

* * * * *